US008726602B2

(12) United States Patent
DeLong

(10) Patent No.: US 8,726,602 B2
(45) Date of Patent: May 20, 2014

(54) INTERLOCKING FLOOR TILE

(75) Inventor: Patrick DeLong, Kent, OH (US)

(73) Assignee: Johnsonite Inc., Chagrin Falls, OH (US)

( * ) Notice: Subject to any disclaimer, the term of this patent is extended or adjusted under 35 U.S.C. 154(b) by 125 days.

(21) Appl. No.: 13/311,979

(22) Filed: Dec. 6, 2011

(65) Prior Publication Data

US 2013/0139463 A1 Jun. 6, 2013

(51) Int. Cl.
*E04B 2/08* (2006.01)
*E04B 2/00* (2006.01)
*E04F 15/22* (2006.01)

(52) U.S. Cl.
USPC ..... 52/589.1; 52/403.1; 52/588.1

(58) Field of Classification Search
USPC ..... 52/588.1, 586.1, 592.1, 589.1, 177, 52/403.1, 390, 385
See application file for complete search history.

(56) References Cited

U.S. PATENT DOCUMENTS 1,661,037 A * 2/1928 Gammeter ..... 404/33
4,649,069 A 3/1987 Tone
4,766,022 A 8/1988 Tone
4,890,432 A 1/1990 Shepherd
4,945,697 A * 8/1990 Ott et al. ..... 52/403.1
4,973,505 A 11/1990 Bielous
5,899,038 A 5/1999 Stroppiana
D419,697 S 1/2000 Kroesbergen
D449,120 S 10/2001 Kulik
D486,592 S * 2/2004 Hong ..... D25/138
6,694,689 B1 2/2004 Scott et al.
D497,212 S 10/2004 Poliacek et al.
7,086,205 B2 8/2006 Pervan
7,127,860 B2 10/2006 Pervan et al.
7,275,350 B2 10/2007 Pervan et al.
7,340,865 B2 3/2008 Vanderhoef
7,356,971 B2 4/2008 Pervan
7,484,338 B2 2/2009 Pervan et al.
7,516,588 B2 4/2009 Pervan
7,610,731 B1 11/2009 Collison
7,676,995 B2 3/2010 Vanderhoef
7,677,001 B2 3/2010 Pervan
8,192,823 B2 * 6/2012 Hainbach ..... 428/78
2002/0178682 A1 12/2002 Pervan
2003/0093964 A1 * 5/2003 Bushey et al. ..... 52/592.1
2004/0035079 A1 2/2004 Evjen
2005/0183370 A1 * 8/2005 Cripps ..... 52/591.5
2006/0283127 A1 * 12/2006 Pervan ..... 52/592.1
2007/0011980 A1 * 1/2007 Stegner et al. ..... 52/586.1
2007/0159814 A1 7/2007 Jacobsson
2008/0000194 A1 1/2008 Pervan et al.
2008/0010937 A1 1/2008 Pervan et al.
2008/0028707 A1 2/2008 Pervan
2008/0037284 A1 2/2008 Rudisill (Continued)

*Primary Examiner* — Andrew J Triggs
(74) *Attorney, Agent, or Firm* — D. Peter Hochberg; Sean F. Mellino; Richard A. Wolf

(57) ABSTRACT

A flexible interlocking floor tile having a dual construction with an interlocking mechanism allows for easy installation of multiple tiles. The dual construction can include recycled material and new material. The tile also includes an adequate support at the corner of the tile when assembling multiple tiles. The tile has a single interlocking structure or groove to keep the entire tile joint tight with other tile joints, instead of interrupted interlocking structure which can lead to functional and aesthetic flaws in the entire floor. The single continuous interlocking structure allows for a one-step easy removal of any excess material or flashing from the tile after the molding process.

23 Claims, 15 Drawing Sheets

(56) References Cited

U.S. PATENT DOCUMENTS

| | | | | |
|---|---|---|---|---|
| 2008/0209840 | A1 | 9/2008 | Vanderhoef | |
| 2009/0062432 | A1* | 3/2009 | Doesburg et al. | 524/16 |
| 2011/0167744 | A1* | 7/2011 | Whispell et al. | 52/309.1 |
| 2012/0009377 | A1* | 1/2012 | Dodge et al. | 428/90 |
| 2012/0189819 | A1* | 7/2012 | Chang | 428/172 |
| 2012/0322517 | A1* | 12/2012 | Valdez | 455/575.8 |
| 2013/0139463 | A1* | 6/2013 | DeLong | 52/588.1 |
| 2013/0139464 | A1* | 6/2013 | DeLong et al. | 52/588.1 |

* cited by examiner

INTERLOCKING FLOOR TILE

BACKGROUND OF THE INVENTION

1. Field of the Invention

The invention relates to floor tiles, and is directed in particular to a flexible interlocking floor tile made from rubber, vinyl, polyvinyl chloride (PVC), plastic or the like. More particularly, the invention relates to interlocking floor tiles which can be easily manufactured and installed without the need of a professional installer.

2. Description of the Prior Art

Various types of commercial flooring are known in the art. Such places which utilize commercial flooring are usually high traffic areas and include office buildings, hospitals, recreation centers, etc. These high traffic areas require durable yet inexpensive flooring with aesthetic appeal as well. Traditional wood flooring is expensive and difficult to maintain and is not ideal for commercial use. Hard laminate flooring is an alternative to wood flooring but is also expensive. Carpet is not usually desired in high traffic areas since it will wear very quickly, is difficult to clean and must be replaced often, and may impede the travel of vehicles thereacross. Even if the above types of flooring are chosen for commercial use, they require significant time and effort to properly install. If a new building is being constructed, construction may be delayed based on the time it takes for installation of any of the above flooring. Furthermore, removing and replacing any of the above floor types is also expensive and time consuming, which may cause delays in actual operation of the business inside the building. Some such removal and replacement is at times done at night or on weekends so as not to obstruct traffic where such activities are being done.

Based on the above shortcomings of the various flooring mentioned, cheaper yet durable flooring made from rubber, vinyl and the like has been used for commercial settings. Such flooring usually comprises individual molded tiles, panels, boards etc. which interlock together and are placed over a subfloor. Various types of interlocking mechanisms are known in the art. For example, Johnsonite Inc. of Chagrin Falls, Ohio has manufactured an interlock tile under the name UNDERLOCK®. The UNDERLOCK® tile features an interlocking mechanism in the form of a dovetail connection on the underside of the tile which fit together like a puzzle without the need for an adhesive either between the respective tiles, or between the tiles and the floor or subfloor. These UNDERLOCK® tiles are easy to install and uninstall and can be done without a professional installer.

One drawback with most molded products is the presence of flashing that is left behind on the product after the molding process. Flashing is excess material in a thin layer exceeding normal part geometry of the product. The flashing extends from a molded product, and must usually be removed. Flashing is typically caused by leakage of the molding material between the two surfaces of a die or mold that actually leaks out of the mold. With respect to interlocking flooring assemblies, flashing must be removed in order to ensure a precise interlocking fit between the tiles. Any excessive flashing which is not removed from the interlocking tiles may compromise the integrity of the mating of the tiles, which could lead to uneven flooring, curling and peaking etc., and also may add difficulty to the installation of such tiles. The flashing is typically removed by the installer during the installation process. The installer uses a utility knife or other tool to cut away and remove the excessive flashing. Since removal of the flashing is another time consuming step for the installer, a quick and easy method for such removal is desired. Flash removal is particularly time consuming for tiles having intersecting edges, since the installer cannot simple move the utility knife along a straight line, but rather would have to change the direction of movement often. Since flash removal must be done for each tile, the amount of installation time is greatly increased. If the excess flashing is removed by the manufacturer before installation, additional time and expense is still required for this tedious process.

Additionally, some tiles feature a studded partial backing to keep the tiles raised above the subfloor while providing air space between the studs. Such studs allow less contact with the subfloor in the event contaminants and liquids are present. However, the studs extend only over the dovetail configuration or interlocking mechanism and do not cover the entire bottom of this type of tile. The dovetail configuration is often an important feature of this type of tile.

U.S. Publication No. 2005/0183370 to Cripps discloses a floor tile with interlocking edge elements that enable juxtaposed tiles to be assembled by a vertical snap or press-in assembly method to secure tiles together. A first and second pair of contiguous lateral extension walls of the tile are arranged to meet at a square corner of approximately ninety degrees and lie at opposite edges of the tile from the first two lateral extension walls. The second lateral extension walls meet at a common corner that is diagonally opposite from another corner. The floor tile has two channels as a result of first and second lateral extension walls which form part of the interlocking mechanism. The sidewalls forming the channels include an undercut as part of the interlocking mechanism. The tile does not include a downwardly extending member at the corner of the tile for additional support at the corner of tile. The floor tile is made from a unitary material rather than a dual construction made of two materials.

U.S. Publication No. 2007/0011980 to Stegner et al. discloses a unitary interlocking floor tile with interlocks located on adjacent sides of the tile having a gap located at a mid point of the interlocks along each side of the tile, creating a discontinuous interlocking structure on the sides of the tile. The interlocking structure does not fully extend to the corner of the tile. Stegner et al. does not teach a continuous interlocking structure on adjacent sides of a tile extending to the corner of the tile. The discontinuous interlocking structure of Stegner et al. leads to multiple joints when interconnecting the tiles, which can result in a loose fit amongst the tiles, creating both functional and aesthetic problems. If the discontinuous interlocking structure is not a completely straight line between the gap, realignment problems can occur when fitting multiple tiles together, especially if the tiles are staggered and not side by side. The discontinuous locking structure also results in an excessive amount of time required to remove the flashing from the interlocking structure as well as requiring additional time for the installer to remove such flashing, since the direction for the utility knife to move must be interrupted on different sides of the tile. This is due to the gap located at a mid-point of the interlocks along each side of the tile, wherefore the installer cannot remove the flashing in a single motion using a utility knife.

U.S. Publication No. 2003/0093964 to Bushey et al. discloses a floor grid system including a number of interconnectable tiles made from a single unitary material. The tiles are interconnected with one another through the use of locking assemblies extending between the tiles. The locking assembly uses half dove tails as the interlocking configuration. The upper face of the tile includes two locking elements on two adjacent sides of the upper face of the tile. The bottom face of the tile includes two locking elements on the opposite adjacent sides of the bottom face of the tile. Each locking element includes a base projecting outwardly from the tile and an upwardly extending vertical member having an inner surface spaced from a corresponding side of the tile so as to define a wall receiving channel therebetween. The locking elements on adjacent sides of the tile extend beyond the corner of the tile, with a vertical protrusion located that the intersection of the locking elements. Bushey et al. does not include a downwardly extending member at the corner of the tile. Furthermore, the locking elements have numerous edges in difficult directions causing a large amount of time for flash removal.

Accordingly, there is a need for a tile with an interlocking mechanism which is partly spaced from the floor or subfloor and possible contaminants on the floor or subfloor when installed. Such a tile should be easy to manufacture and allow for some misalignment of seams of the tile to allow for different layout designs and for multiple size tiles to be fitted together, which does not detract from the aesthetics of the tiles when laid or from their functionality. There is also a need for a tile which reduces the amount of flashing to be removed, and which is easier to install and re-install than existing tiles, saving installation time. Desirably, such a tile would allow for a continuous connection along all of the sides of the tile and include adequate support at the corner of the tile. The latter feature would prevent bending or buckling of the corners of overlapping tile portions, as when a high heel shoe is pressed thereon. The desired tile would have a single interlocking structure or groove to keep the entire tile joint tight with other tile joints, instead of interrupted interlocking structure which could lead to functional and aesthetic flaws in the entire floor. The single continuous interlocking structure would allow for a one-step easy removal of any excess material or flashing from the tile after the molding process. The tile would desirably include a continuous uniform distribution of shallow studs on the entire bottom of the tile to allow for the wicking of moisture and prevention of exposure of the interlocking mechanism to contaminants from the subfloor. Most desirably, such a unit maintains a strong, structurally sound mounting of the tile on the floor which allows for easy installation. Time saving is particularly important in multiple room facilities where flooring needs to be installed quickly and cost efficiently such as for apartment buildings, hospitals, hotels and the like, where new building construction and renovations are common. Thus, the problem to be solved by the present invention is to provide a tile with the above characteristics.

Many floor tiles are made entirely of relatively expensive vinyl or artificial rubber. This can be expensive, particularly for commercial buildings with extensive floor space to be covered with the tile. It would be advantageous to employ less expensive recycled vinyl, artificial rubber or the like on part of the underside of the tile where it is not visible after it is laid, yet serves its intended purpose and has all of the necessary structural features.

SUMMARY OF THE INVENTION

The present invention provides a flooring solution to the above-described problems of producing and installing interlocking floor tiles. Applications of the interlocking floor tile according to the present invention may include covering access floors, temporary office quarters, workout areas, subfloors with high moisture content or even trade show floors—areas where performance and flexibility are equally important. The interlocking floor tiles are designed to fit together without the locking structure underneath the respective tiles being readily observable, and if observed being nevertheless aesthetic. Damaged tiles can be easily removed according to the preferred embodiment of the invention as discussed below, even in the middle of the floor and replaced, without any special tools required; removal and replacement are accomplished as discussed below, by simply pulling up the damaged tile and replacing it.

It is an object of the present invention is to provide an interlocking floor tile that can be easily installed and re-installed without necessarily requiring a skilled installer.

It is also an object of the present invention to provide an interlocking floor tile which could be installed using a hand seam roller to locking the respective tiles together.

Another object of the present invention is to provide an interlocking floor tile having a continuous connection along all of the sides to keep the entire joint tight between the tiles.

Still another object of the present invention is to provide a tile with adequate support at the corner of an installed set of tiles.

A further object of the present invention is to provide an interlocking floor tile with an interlocking mechanism which is not completely and directly exposed to the subfloor and any contaminants thereon.

It is a further object of the present invention is to provide an interlocking floor tile which does not require an adhesive for installation either between the respective tiles or between the tiles and the floor or subfloor.

Still another object of the present invention is to provide an interlocking floor tile which is portable and can be used for both temporary and permanent installations.

Another object of the present invention is to provide an interlocking floor tile which can be placed directly over uncured concrete slabs.

A still additional object is to provide an improved interlocking floor tile system that can be installed on subfloors with high moisture content.

A further object of the present invention is to reduce significant installation time and the associated expense with flooring installation techniques making it easier to lay the inventive tiles as compared to laying existing tiles, and by reducing flashing that must be removed and the overall time required for installation.

Yet another object of the present invention is to provide an interlocking floor tile which can be easily removed due to damage or other problems and replaced without any special tools.

Another object of the present invention is to provide an interlocking floor tile having a dual construction and comprises in part non-observable recycled artificial rubber or other material having a lower cost than the visible portion of the tile.

Still another object of the present invention is to reduce the weight of the tile without reducing the functions of the tile or the area of coverage of each tile, by incorporating shallow studs on the bottom of the entire tile, which would additionally make the improved tile easier to install, remove and \transport.

Yet another object of the present invention is to provide an interlocking floor tile which is slip resistant.

It is yet still another object of the invention to provide an improved interlocking floor tile which can be easily maintained.

A further object of the present invention is to provide an interlocking floor tile which is fire resistant and has a Class 1 Flame Rating.

Another object of the present invention is to provide an interlocking floor tile that can accommodate various size tiles to create unique and aesthetic patterns.

It is also an object of the present invention to provide an improved interlocking floor tile having the advantages noted above which can be laid in a traditional corner-to-corner pattern or offset to create a staggered look.

It is a general object of the invention to provide an improved tile which is effective in its production, installation and use, and which can be manufactured efficiently and economically.

BRIEF DESCRIPTION OF THE DRAWINGS

Other characteristics and advantages of the present invention will emerge from reading the detailed description hereinbelow of nonlimiting embodiments of the invention, and examining the attached drawings wherein.

DETAILED DESCRIPTION OF THE PREFERRED EMBODIMENTS

Figure 1A:
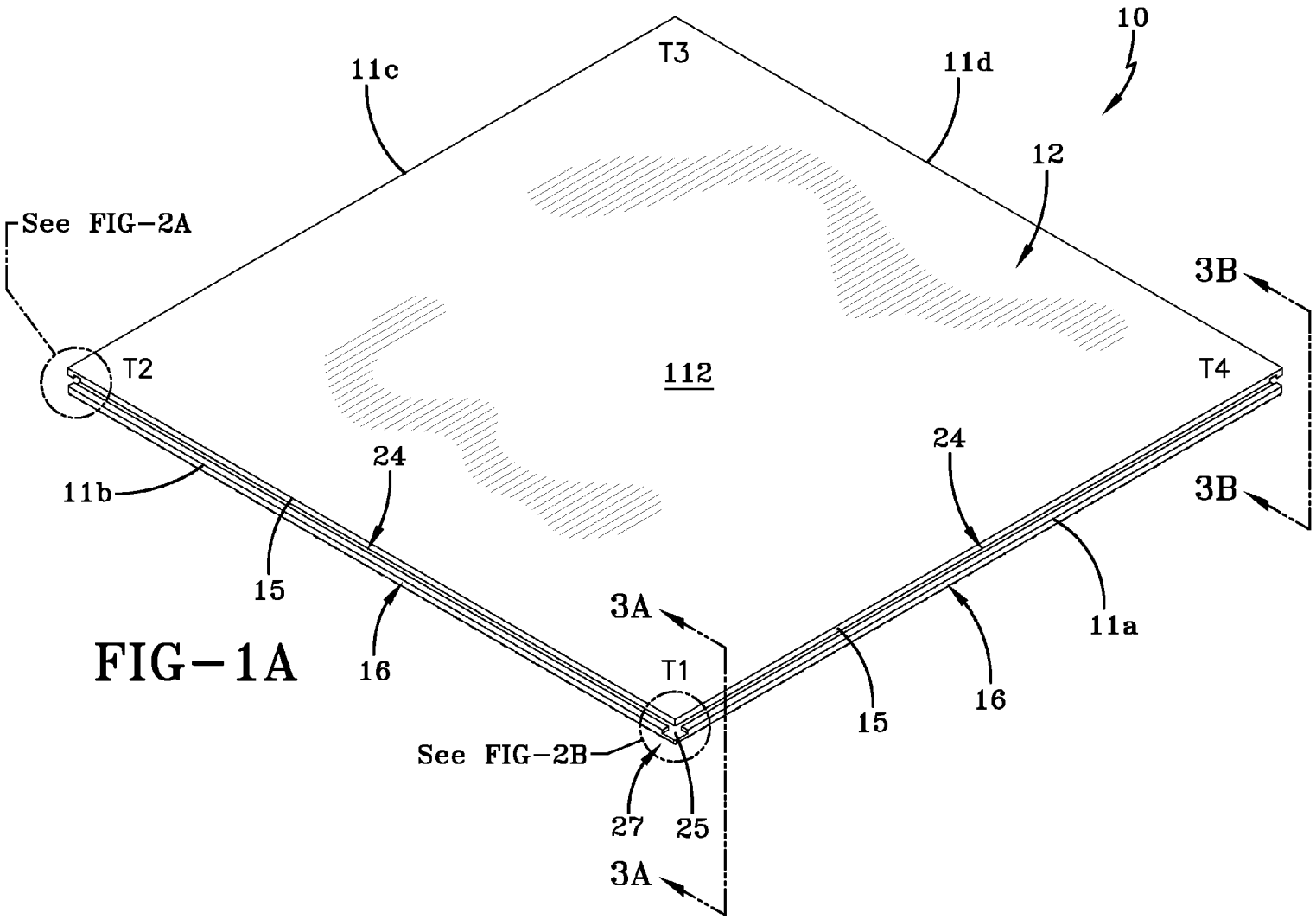
FIG. 1A is a top perspective view of the interlocking floor tile according to the present invention.

The preferred embodiment of the present invention relates to an improved floor tile with an interlocking mechanism which is easy to be laid with a quality installation. The installed inventive floor tile is not completely and directly exposed to the subfloor and any contaminants thereof. The interlocking floor tile can be formed of any suitable flexible material, such as plastic, vinyl or rubber (including artificial rubber), among others. As recited herein, a flexible tile is defined as a tile which is made from plastic, vinyl, polyvinyl chloride (PVC) or rubber. The tiles are not limited to a specific size but can be designed in any size to accommodate the size of the subfloor or floor and the space to be covered. The tile is preferably composed of an attractive exposed material when installed, with low cost but effective inexpensive material which is not exposed when the tile is installed. The inventive tile can be placed on a floor or subfloor, slid relative to adjacent tiles to the desired position, and pressed together with the adjacent tile to interlock them together. Preferably no adhesive is required to install tiles according to the invention.

Turning now to FIGS. 1A, 1B and 4A, 4B, illustrated is an example interlocking floor tile 10 according to the preferred embodiment of the present invention. Each tile 10 is preferably made of dual construction, meaning each tile 10 includes a top portion 12 made from one material and a bottom portion 14 except for its edge portions, made from another material. Both layers have rubber components. More than two different materials could be also be used. In a preferred embodiment, flexible interlocking floor tile 10 is composed of 73% recycled rubber and 27% new rubber. Top portion 12 includes a large top layer 112 which is a finish layer for aesthetics and performance, and can be made from any number of materials known in the art capable of being flexible and resilient to absorb shock and returned if momentarily bent or indented, to its original shape. For example, top layer 112 could be made from rubber, which has a greater elastic effect. Top layer 112 may include a number of different components for performance, such as SBR rubber and clay. SBR (styrene-butadiene-rubber) is a synthetic rubber copolymer consisting of styrene and butadiene. Top layer 112 may also include pigments and/or a design for aesthetic purposes. As discussed below, the harder material of top layer 112 is also used for the edge of top portion 12 and part of the edge of bottom portion 14. According to a preferred embodiment, bottom portion 14 is 7.5 mm in height and top portion 12 is 2.0 mm in height.

Bottom portion 14 includes large base layer 100 of less expensive, preferably softer material such as recycled rubber discussed below. Large base layer 100 extends to a very edge 102 of tile 10 on two sides, only up to a pair of channels discussed below at edges 104 and 106 of large base layer 100, and to an edge 108 shown as a line, all depicted in FIGS. 4A, 4B. Base layer 100 provides padding and absorbs some of the shock from loads on tile 10. Base layer 100 can be made from a cheaper material than top layer 112. For example, base layer 100 can be made from industrial rubber scrap or recycled rubber including recycled SBR rubber. New SBR rubber, natural rubber and vulcanized recycled rubber dust may also be used.

Top portion 12 and bottom portion 14 are combined together to form a dual construction tile by vulcanization, which is well known in the art. Top portion 12 comprises a sheet of rubber as defined above while bottom portion 14 includes a sheet of recycled rubber as previously mentioned. The respective sheets are stacked on top of each other and put into a mold in a press, i.e. top portion 12 is stacked on top of bottom portion 14. The two sheets are then bonded by the vulcanization process without the use of a bonding agent. It is possible that during the vulcanization process that the two different sheets of different material may overflow into either top portion 12 or bottom portion 14.

Each tile 10 can have any desired polygonal shape, but is preferably generally rectangular in shape for ease of interlockability. For tiles having any polygonal shape, a side portion of a first tile will have a specific shape while a side portion of another tile adjacent the side portion the first tile will have a corresponding mating shape. It is also possible for a single tile to have a side portion having a specific shape while a side portion opposite of the first side portion of the tile has a corresponding mating shape. For example, if the tile is in the shape of a crescent moon, a side portion of this tile will have a convex shape, while the shape of a side portion of another crescent moon-shaped tile adjacent the side portion of the first tile will be concave. Thus, the respective side portions have corresponding mating shapes.

Figure 1B:
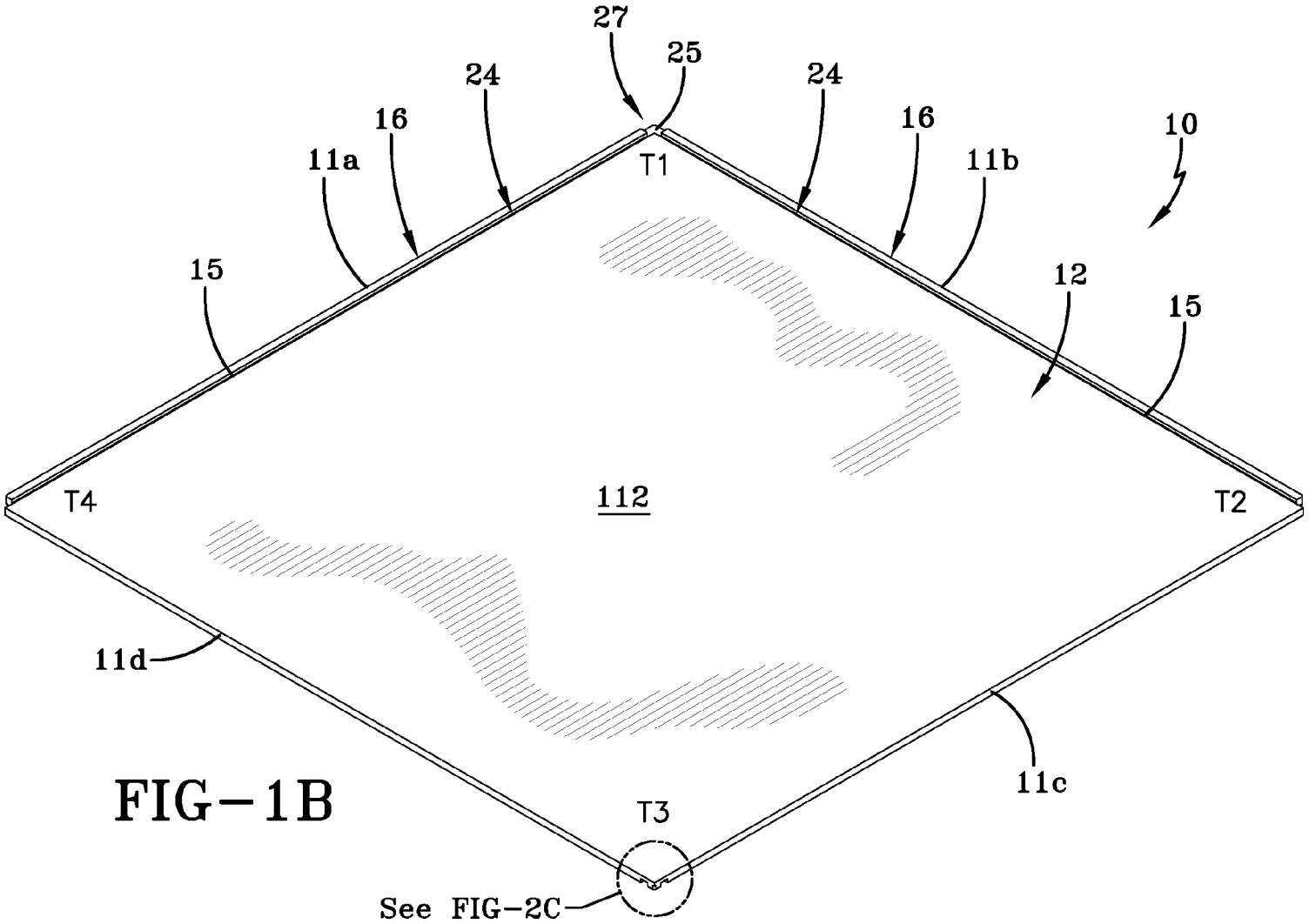
FIG. 1B is a top perspective view of the tile of FIG. 1 shown from another angle of the tile.
Figure 2A:
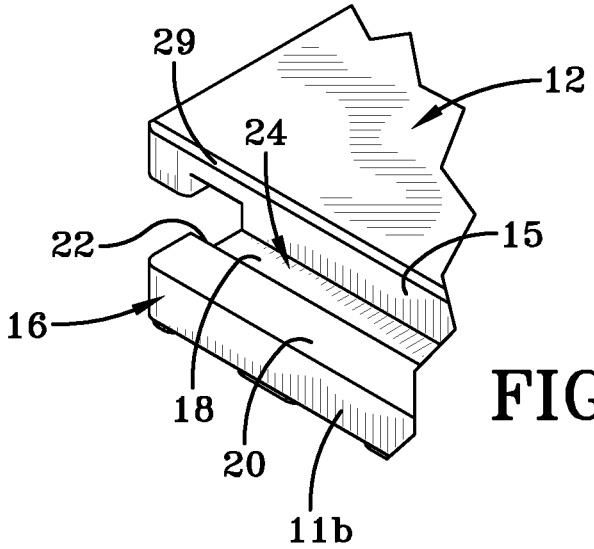
FIGS. 2A-2C are enlarged partial top perspective views of several corners of the tile of FIG. 1.
Figure 2B:
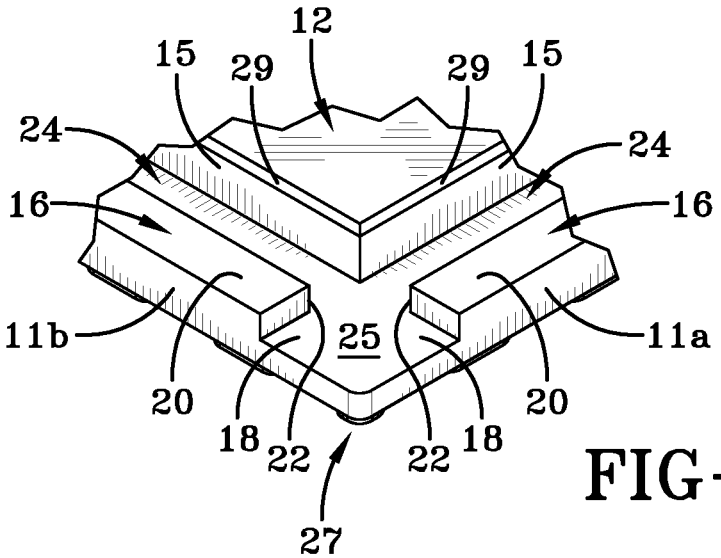
Figure 2C:
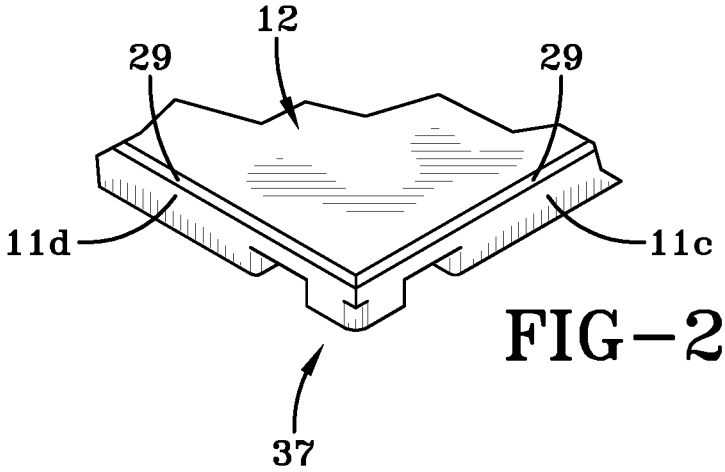

As shown in FIGS. 1A, 1B, top layer 112 includes outwardly-facing top planar sidewalls 15 on each of two adjacent side portions 11*a*, 11*b* of tile 10. A bottom interlocking element set 16 is included in top portion 12, is separated from top layer 112 and is located adjacent outwardly-facing top planar sidewall 15 on each of two adjacent side portions 11*a*, 11*b* of tile 10. Referring to FIGS. 2A-3C, bottom interlocking element set 16 includes a bottom base 18 and a bottom upwardly extending male locking projection 20. Bottom base 18 extends outwardly from outwardly-facing top planar sidewall 15 near bottom portion 14 of tile 10. Bottom upwardly extending male locking projection 20 has an inwardly-facing bottom planar wall 22 spaced from outwardly-facing top planar sidewall 15 of corresponding side portions 11*a*, 11*b* of tile 10 so as to define a bottom channel 24 therebetween. Bottom interlocking element sets 16 are made from a dual construction, i.e. they are composed of both material from top portion 12 and of material from bottom portion 14.

Respective bottom interlocking element sets 16 on respective adjacent side portions 11*a*, 11*b* are connected by a bottom base element 25 at a corner 27 of tile 10. A bottom base element 25 is an extension of bottom base 18 but is devoid of any male locking portion projecting therefrom. Bottom base element 25 provides support for a corner post of an adjacent interlocking floor tile 10 when joined together as further explained below.

Figure 4A:
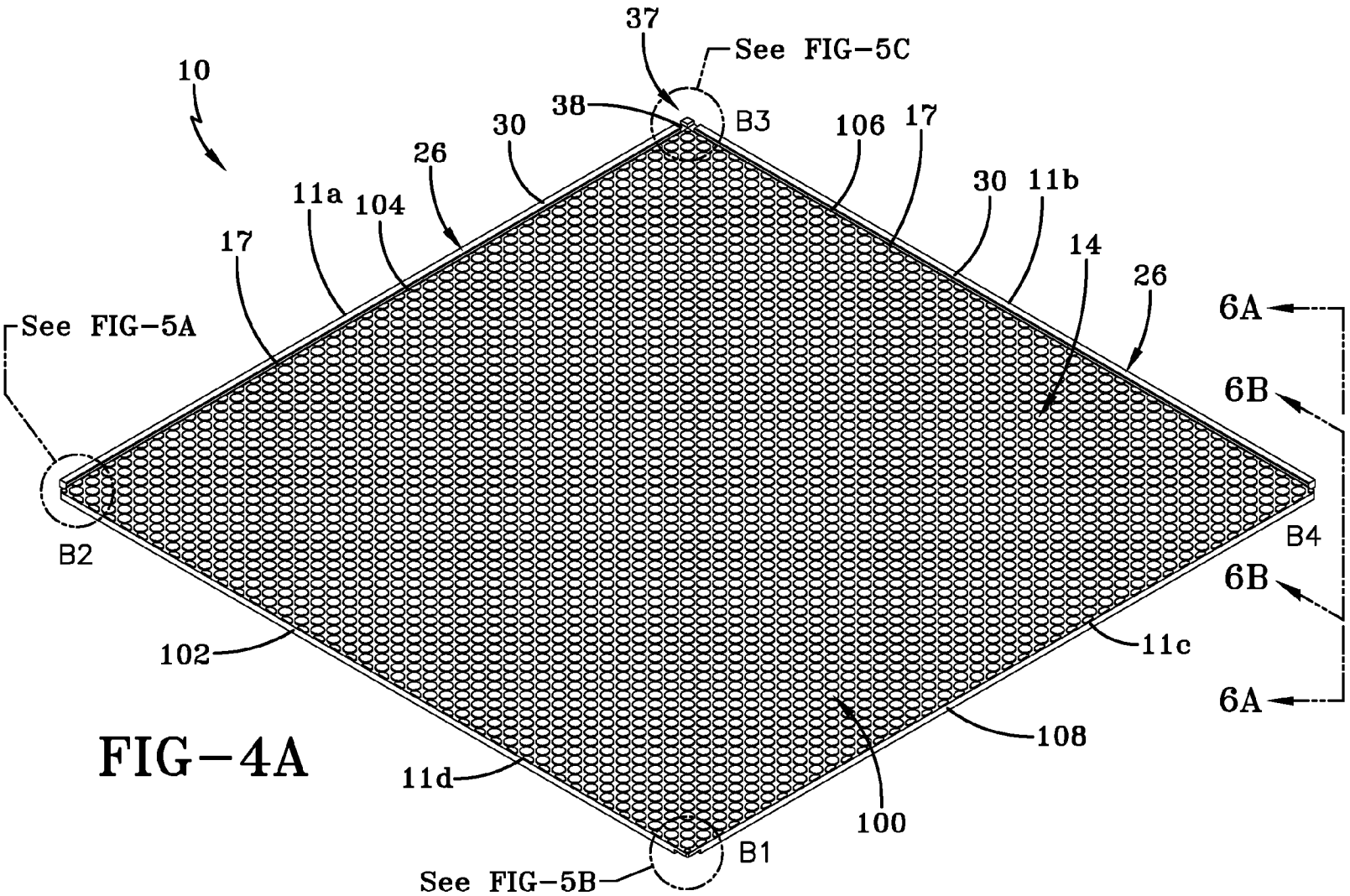
FIG. 4A is a bottom perspective view of the tile of FIG. 1.
Figure 4B:
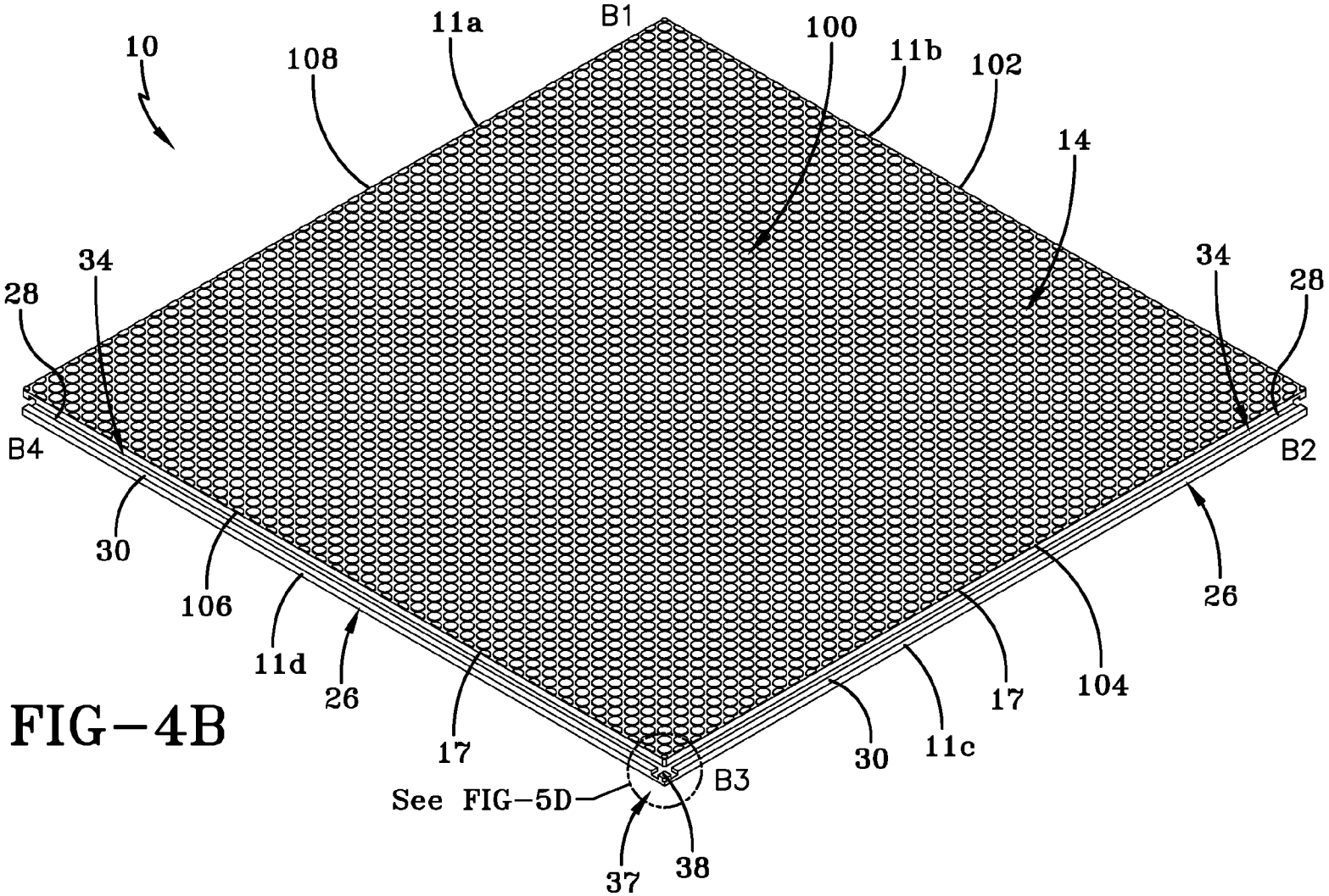
FIG. 4B is bottom perspective view of the tile of FIG. 1 shown from another side of the tile.

When viewed from the bottom, shown in FIGS. 4A, 4B, base layer 100 includes outwardly-facing bottom planar sidewalls 17 on each of the other two adjacent side portions 1 ic, 11*d* opposite from side portions 11*a*, 11*b* on top portion 12 of tile 10. Each adjacent side portion 11*c*, 11*d* includes a top interlocking element set 26. Referring to FIGS. 5A-6B, top interlocking element set 26 includes a top base 28 and a top male downwardly extending (when bottom portion 14 is facing downwardly) locking projection 30. Top base 28 projects outwardly from each outwardly-facing bottom planar sidewall 17 of respective side portions 11*e*, 11*d* near the top of tile 10 and top downwardly-extending male locking projection 30 extends downwardly from top base 28. Top downwardly-extending male locking projection 30 has an inner wall 32 (FIG. 5A) spaced from sidewall 17 of a corresponding side 11*c*, 11*d* of tile 10 so as to define a top channel 34 therebetween.

Figure 5A:
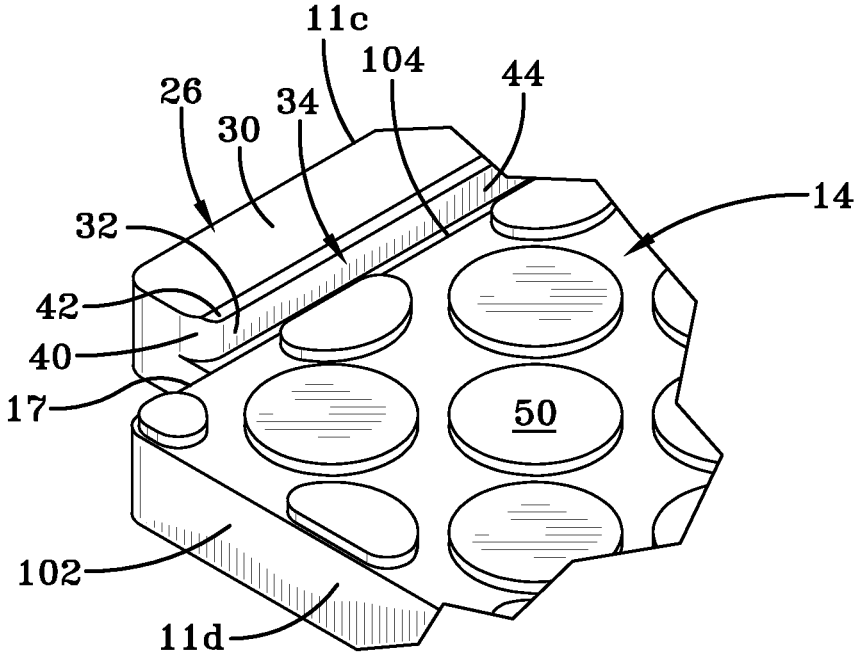
FIGS. 5A-5D are enlarged partial bottom perspective views of several corners of the tile of FIG. 1.
Figure 5B:
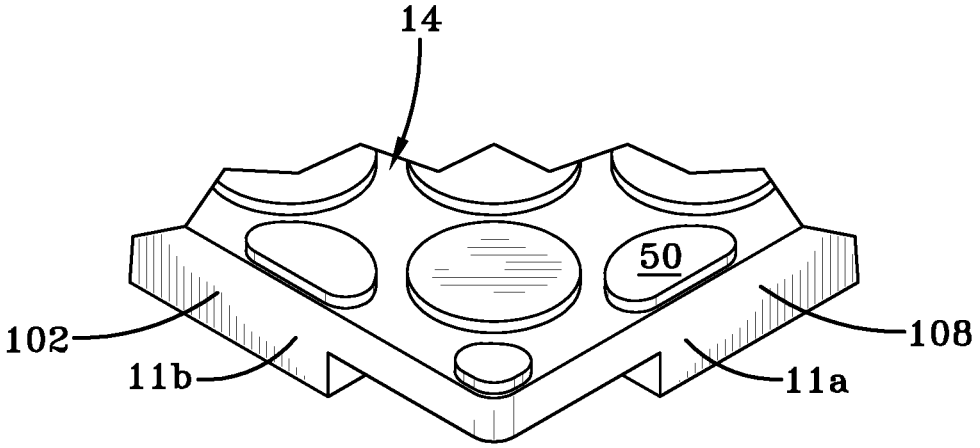
Figure 5C:
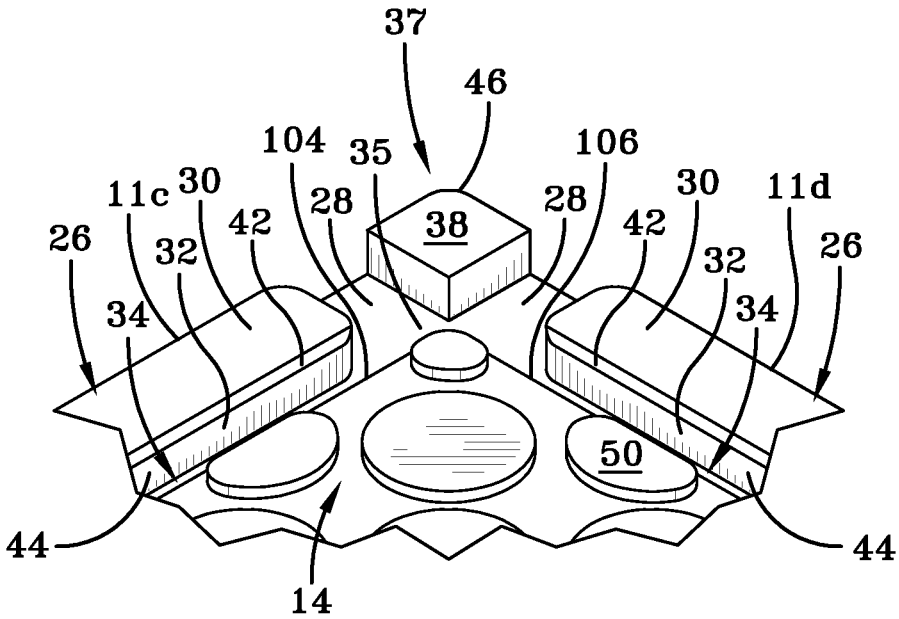
Figure 5D:
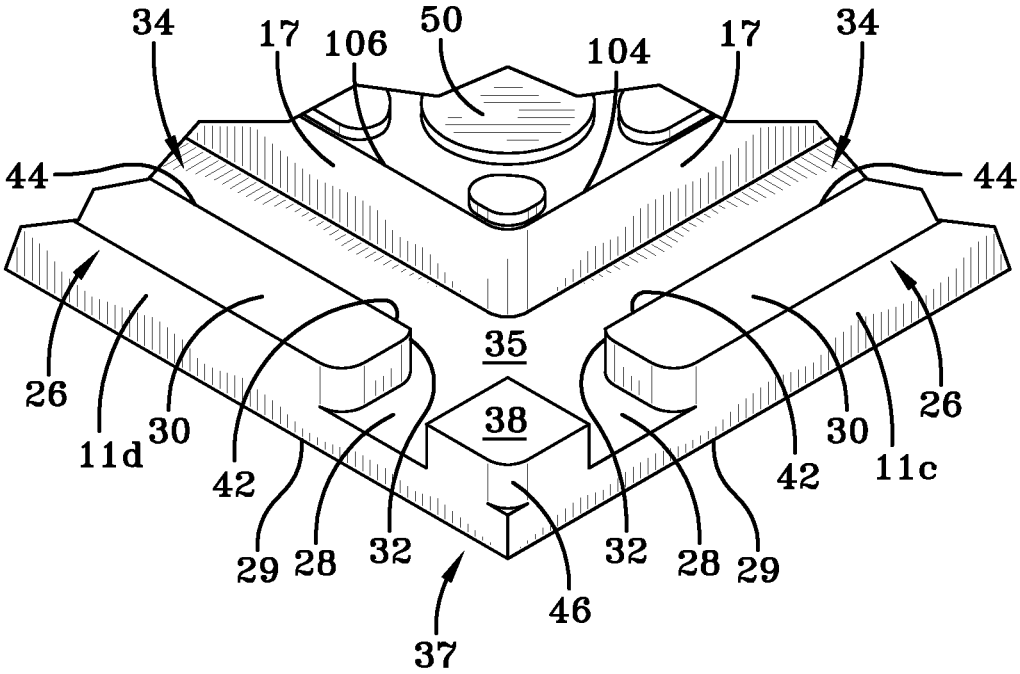
Figure 8A:
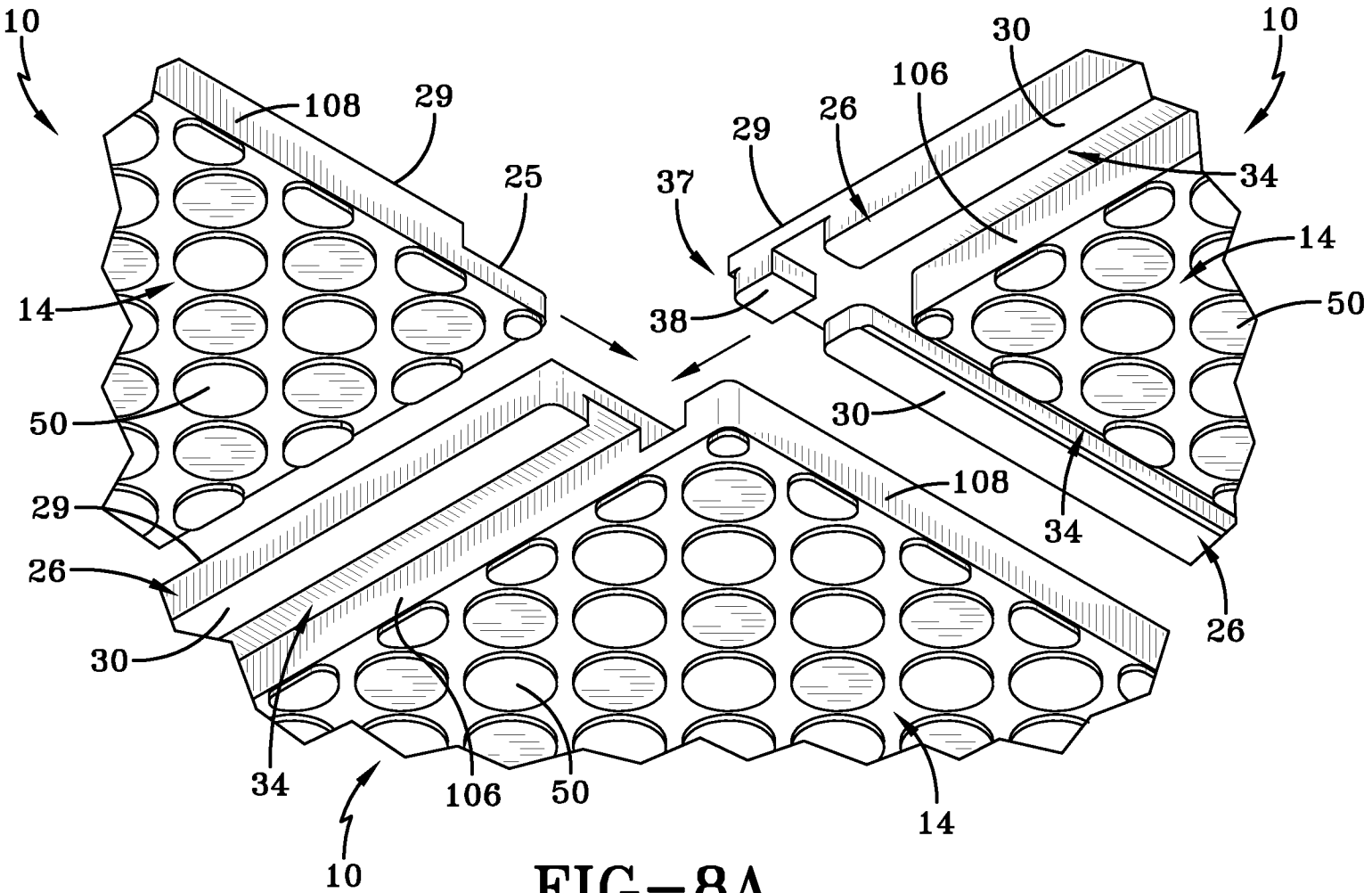
FIG. 8A is a bottom partial perspective view of three adjacent tiles before assembly.
Figure 8B:
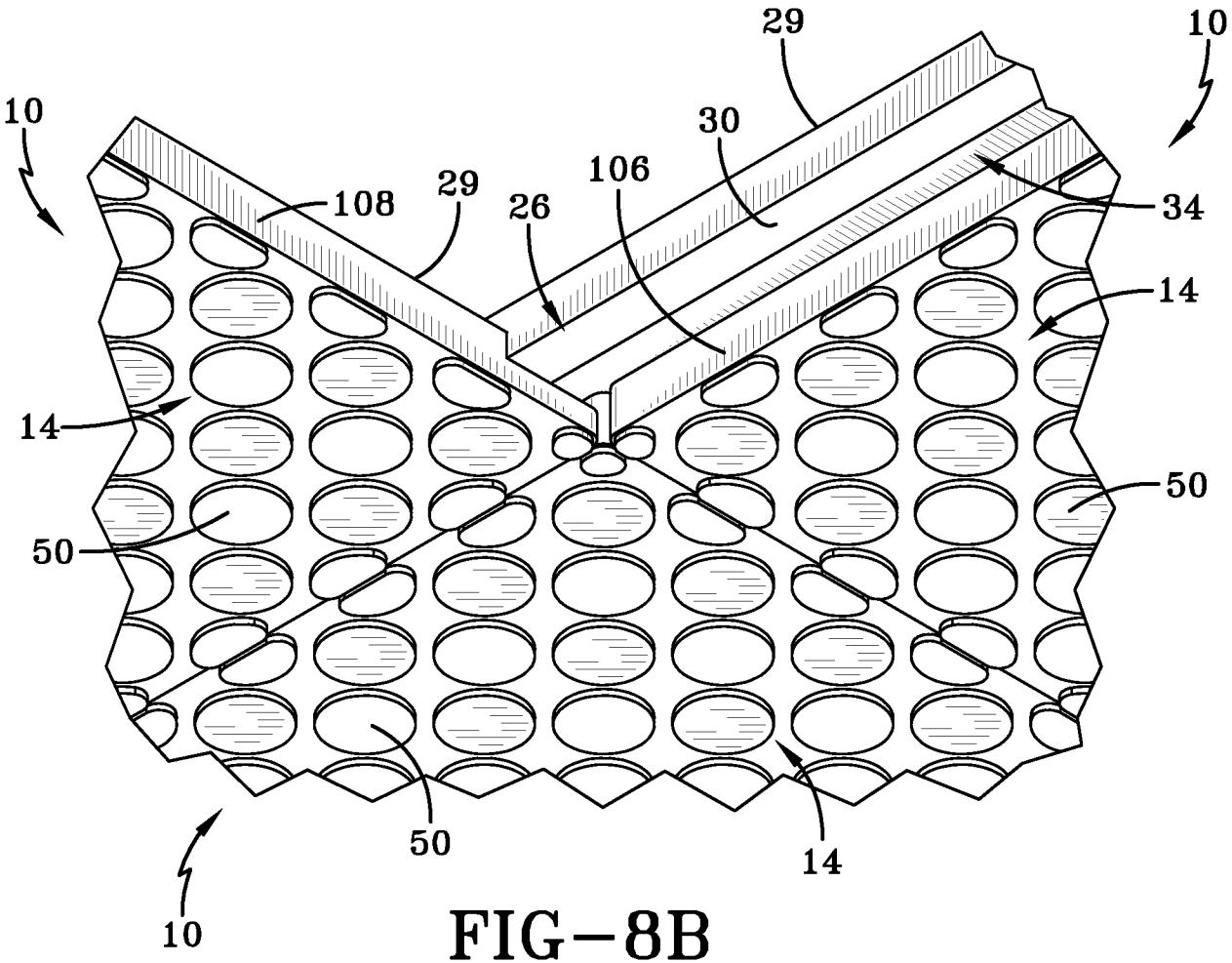
FIG. 8B is a bottom partial perspective view of three adjacent tiles after assembly.

As shown in FIGS. 5C-5D, respective top interlocking element set 26 on respective adjacent side portions 11*c*, 11*d* are connected by a top base element 35 at an upper corner 37 of tile 10, top base element 35 being an extension of top base 28. Top base element 35 is substantially the same thickness as top base 28 (i.e., top base element 35 is level with top base 228) and includes a support post 38. Support post 38 depends downwardly from top base element 35 towards the subfloor when tile 10 is installed. Support post 38 provides support in conjunction with bottom base element 25 upon which it is seated near the corner of an adjacent tile 10 when joined together as shown from the bottom of multiple tiles 10 being joined together in FIG. 8A. FIG. 8B shows multiple tiles 10 joined together from FIG. 8A, but support post 38 is hidden from view. Bottom base element 25 on top portion 12 does not have any male projections in order to allow clearance for top male locking element set 26 to pass therethrough when multiple tiles 10 are joined together. When multiple tiles 10 are joined and respective top locking element set 26 and respective bottom locking element set 16 are connected, a void would be created if support post 38 did not exist. Such a void would create tripping hazard since top base element 35 would not be supported at its upper corner 37 when tile 10 is installed, and would be depressed or deformed by a stiletto, cleat, ice skate or other shoe with a pointed structure on the bottom of the shoe. However, support post 38 fills the void and fully supports the corner of tile 10. It is advantageous that support post 38 projects downwardly from top base element 35 rather than being located on bottom base element 25 and projecting upwardly. When depressed by a shoe (or part of a shoe such as a stiletto heel etc.), support post 38 effectively prevents any movement of upper corner 37 (such as sliding or shearing) with bottom base element 25 of another tile 10. However, if support post 38 was located on bottom base element 25, there is believed to be a greater likelihood that upper corner 37 could slide or shear on support post 38 since support post 38 is not connected to upper corner 37 when depressed by shoe (or part of a shoe such as a stiletto heel etc.). This could cause tripping and possible injury to the person walking (or running) on tile 10.

Figure 3A:
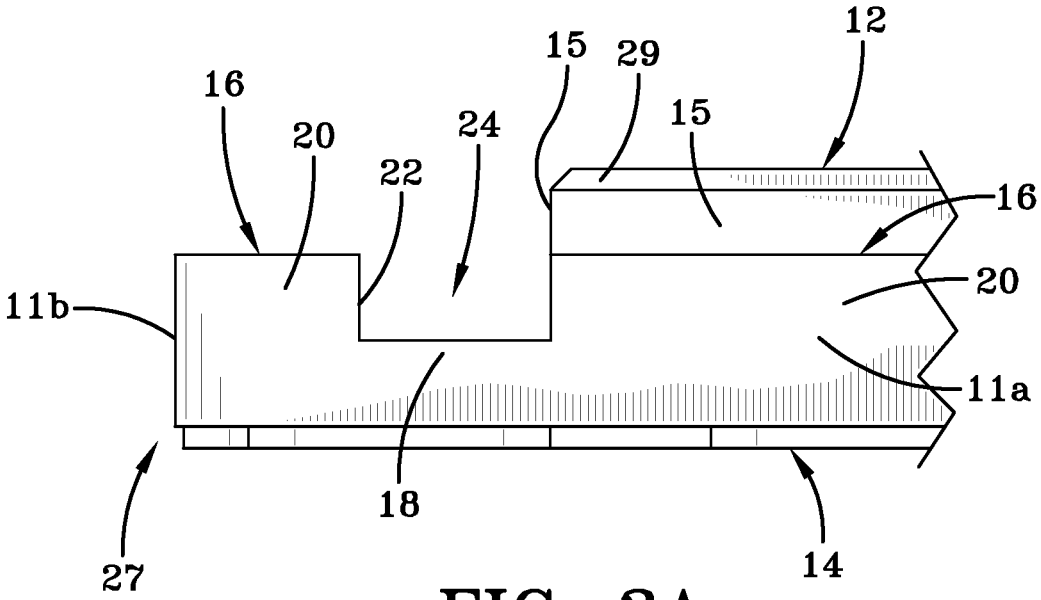
FIG. 3A is a partial side view of a corner of one of the sides of the tile of FIG. 1.
Figure 3B:
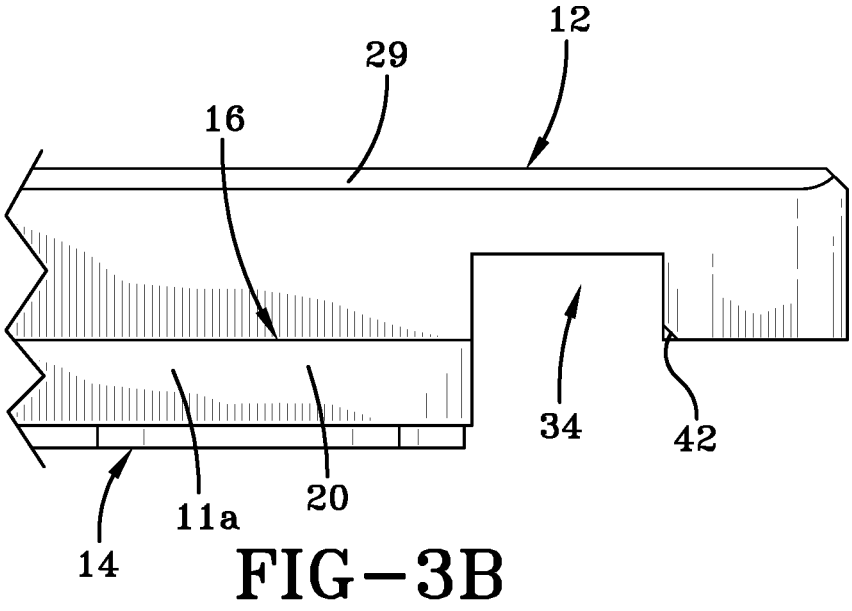
FIG. 3B is a partial side view of a corner of another of the sides of the tile of FIG. 1.
Figure 6A:
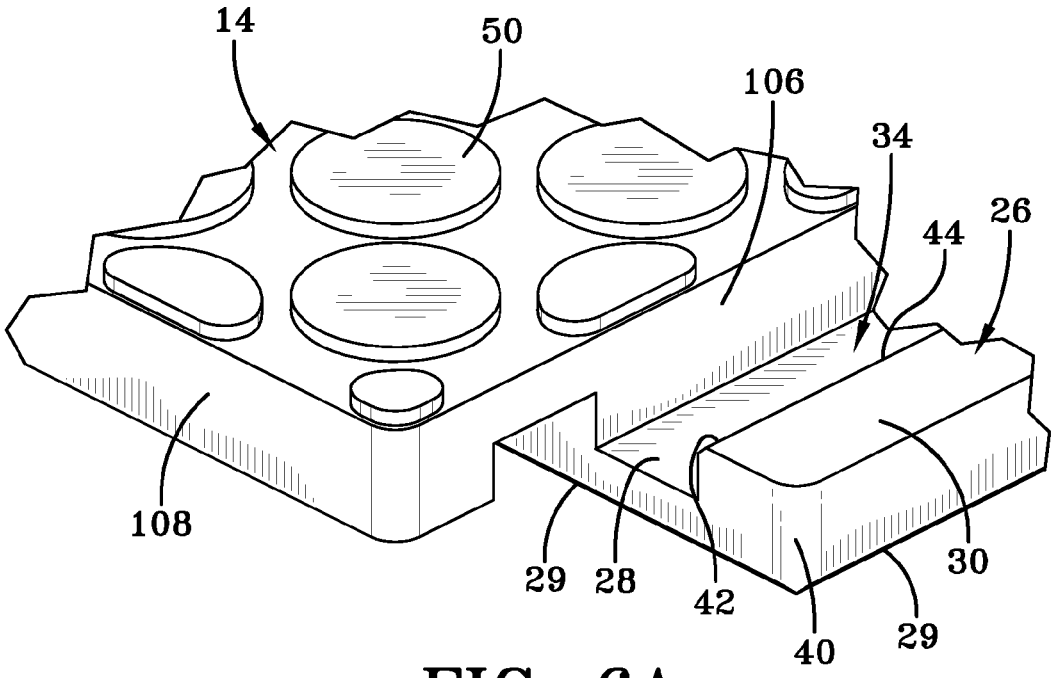
FIG. 6A is another enlarged partial bottom perspective view of another corner of the tile of FIG. 1.
Figure 6B:
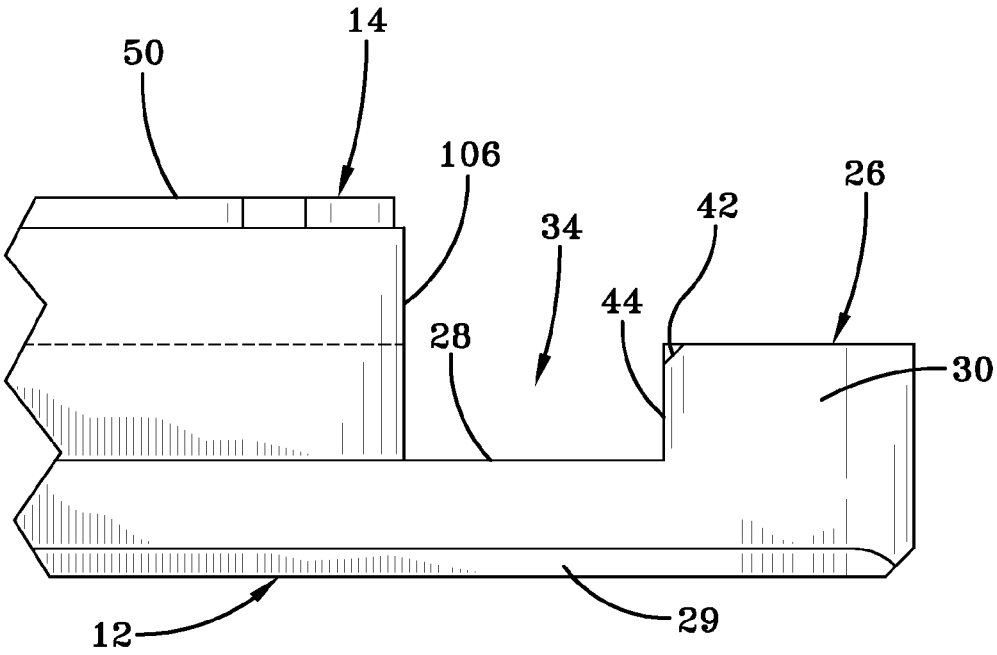
FIG. 6B is a partial side view of a corner of still another side of the tile of FIG. 1.

In a preferred embodiment, the male locking projections 20 and 30 on the corresponding interlocking element sets 16 and 26, respectively, have a generally square-shaped cross-section as shown in FIGS. 3A, 3B and 6B, for reasons hereinafter described. However, the cross-section can include some type of dove-shaped designs as well.

Figure 7A:
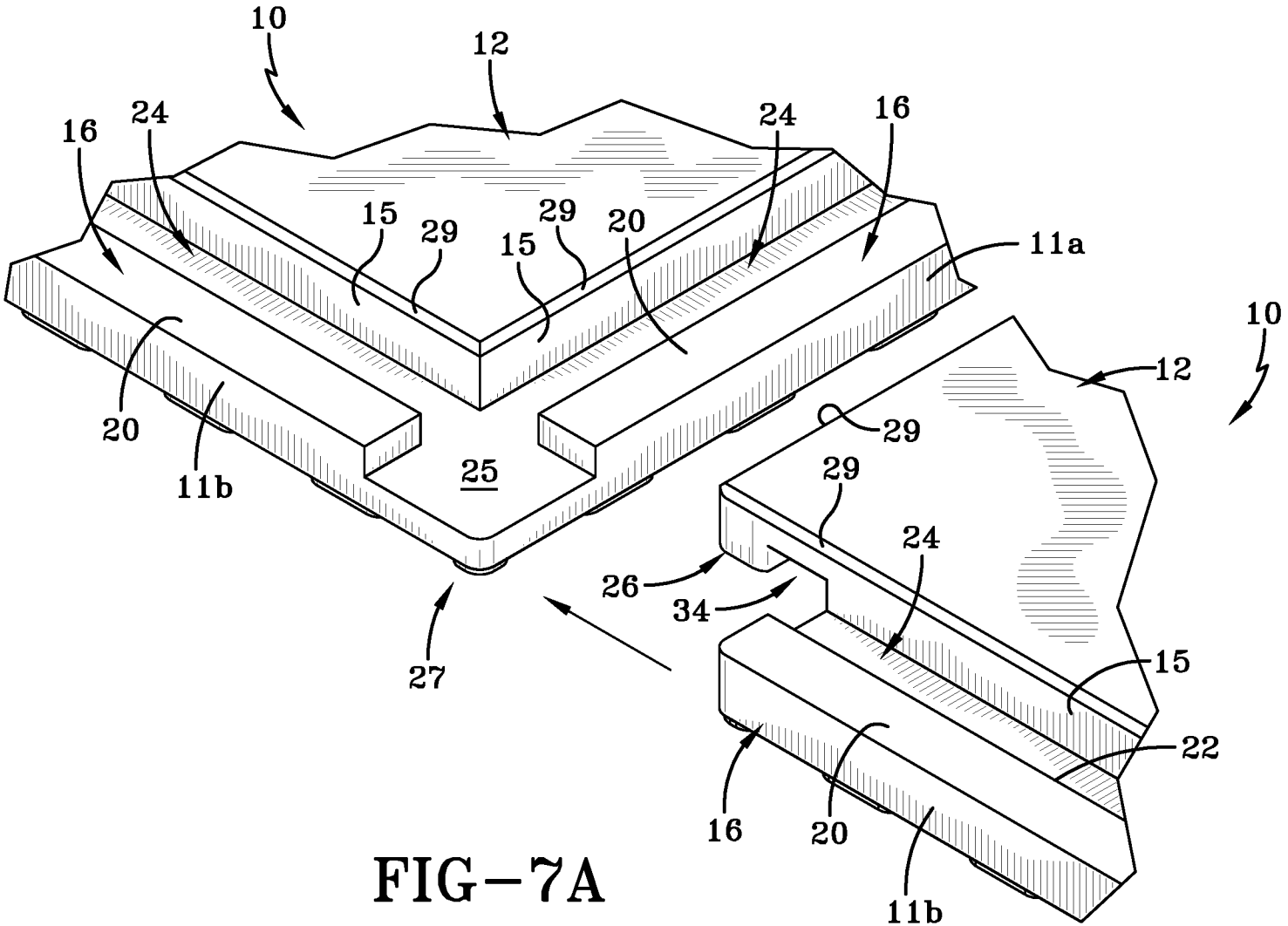
FIG. 7A is a top partial perspective view of two adjacent tiles before assembly.
Figure 7B:
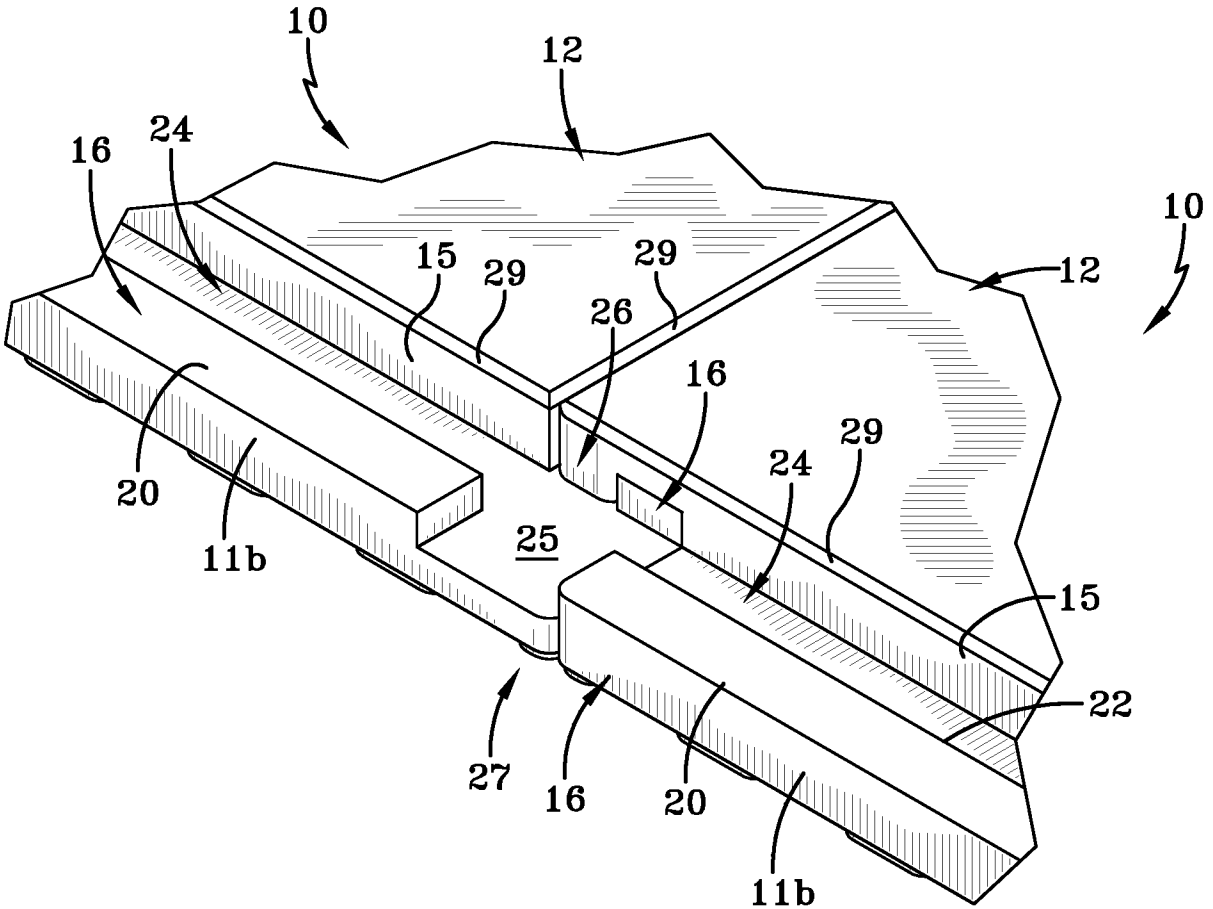
FIG. 7B is a top partial perspective view of two adjacent tiles after assembly.
Figure 7C:
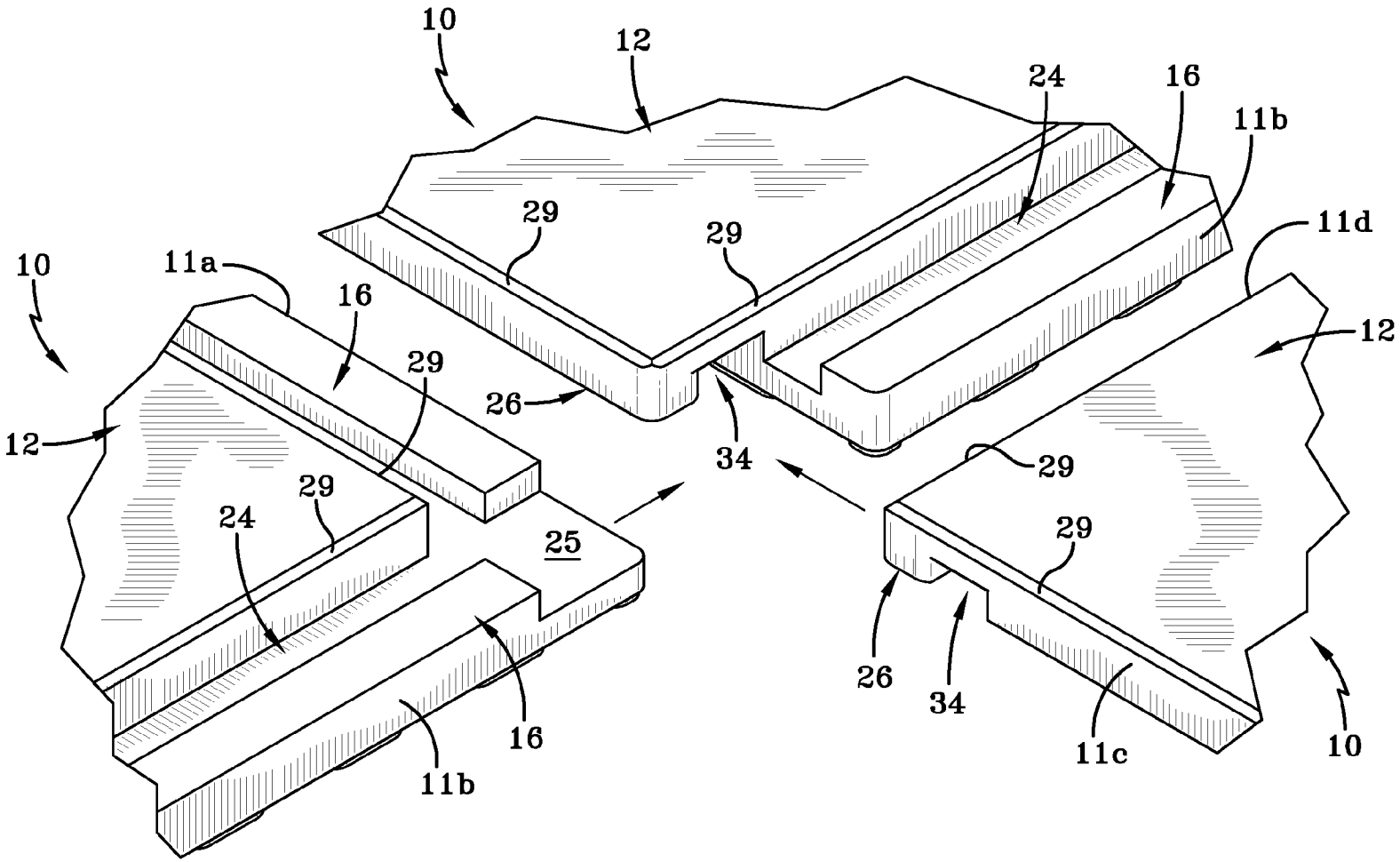
FIG. 7C is a top partial perspective view of three adjacent tiles before assembly.

Considering FIGS. 2A-2C and 3A-3B, the upper edges of each tile 10 are slightly curved or canted as shown at numeral 29. Since when installed the respective tiles 10 may not be in the same plane at their upper surface, one would not want any tile to jut upwardly even if it not be so high as to cause possible tripping when walking thereacross, so as to spoil the smooth appearance. Therefore, curves or cants 29 may be visible, but are not unsightly, which would add aesthetic appeal to the floor as shown in FIGS. 7A-7C. The appearance might be particularly noticeable early or late in the day when sunlight strikes the floor at a very small angle, but would not be visually unpleasant to observe.

Since the present invention is manufactured from molding methods well known in the art, flashing is likely to remain on certain areas of tile 10 as previously discussed. Flashing occurs during the molding process, where rubber or other material oozes along the edges of the mold which leaves excess material (i.e. flashing) after the tile cures. Flashing normally occurs at various edges of tile 10, including the respective interlocking element sets 16 and 26. This excess flashing must usually be removed in order for tiles 10 to be able to lock together. A utility knife or other suitable tool is used to trim the excess flashing. Since the interlocking element sets 16 and 26 run the full length of tile 10 without interruption, excess flashing is easily removed with a utility knife using one continuous motion. There are no curves or sharp corner edges (i.e. puzzle pieces) that need to be traced and subsequently trimmed with the utility knife. This greatly reduces installation time.

Figure 9:
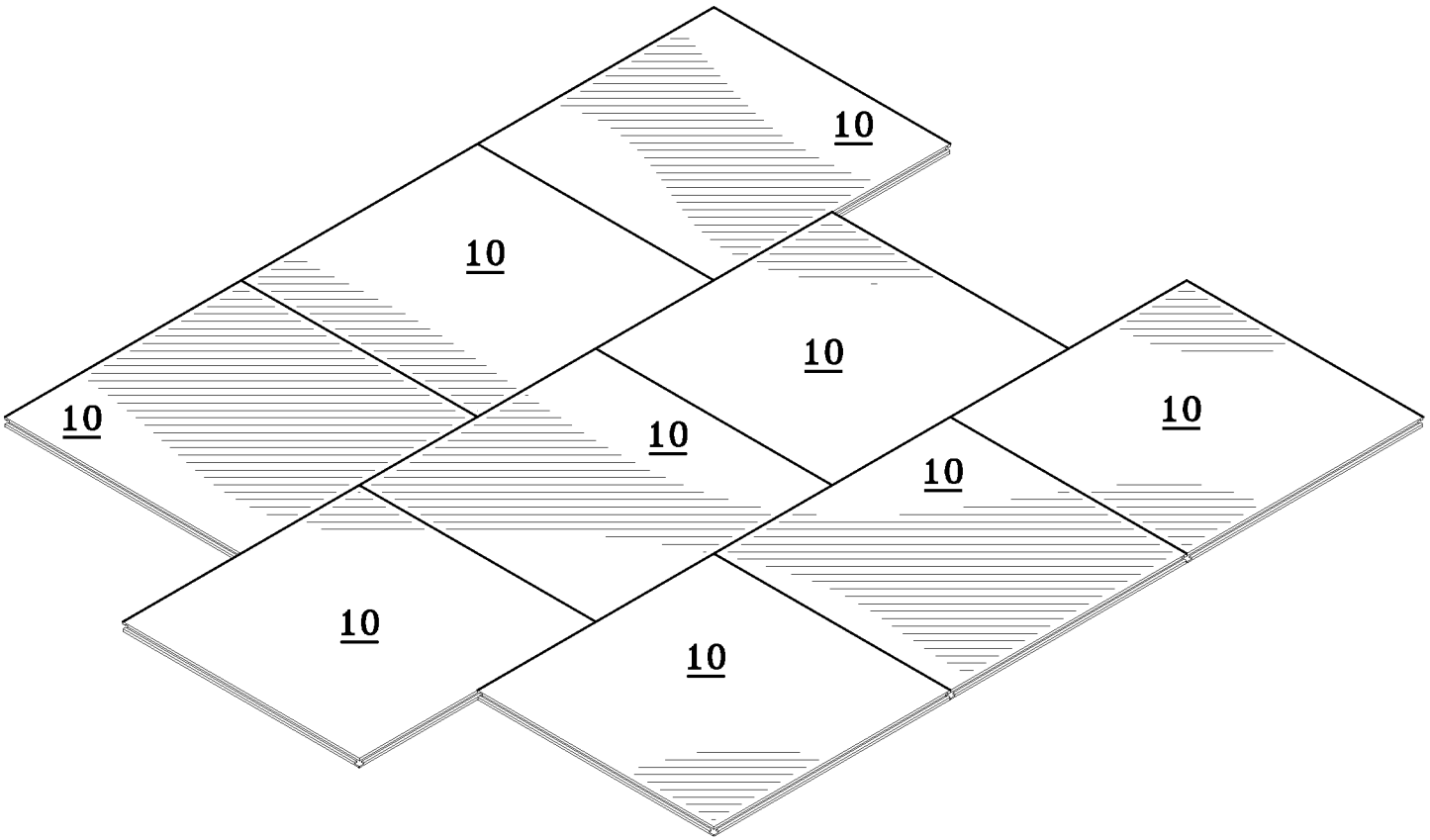
FIG. 9 is a top perspective view of multiple staggered tiles after assembly.

There are additional advantages of the present invention based on the continuous connection along all sides of tile 10 since there is no interruption in respective interlocking element sets 16 and 26. Tiles could be locked together with a commonly used hand seam roller. This allows the connection or joint where two tiles 10 meet to remain tight, which will provide a better appearance and prevent dirt and other debris and even possibly moisture from entering the joint. This could be done with a commonly used hand seam roller. Another advantage of the continuous connection or joint is the prevention of realignment problems with tiles 10. As previously mentioned with respect to the prior art, individual locking tabs or a discontinuous locking connection will result in possible realignment problems. Finally, since the interlocking element sets 16 and 26 run the full length of tile 10 without interruption, the tiles 10 can be staggered to form any type of pattern or design (i.e. tiles 10 do not need to be corner to corner). For example, FIG. 9 shows a number of tiles in a staggered pattern.

In order to maintain a tight joint as discussed above, the interlocking element sets 16 and 26 have a generally square-shaped cross-section as shown in FIGS. 3A, 3B and 6B. Respective male locking projections 20 and 30 are press fit into respective bottom and top channels 24 and 34, respectively, easily done with a hand seam roller. Since tile 10 is flexible, there is some elasticity when male locking projections 20 and 30 are fit into top and bottom channels 24 and 34. However, an initial force must be overcome to begin the press fit of tiles 10 together. In order to help overcome this initial force, interlocking element sets 16 and 26 include rounded and/or chamfered edges and corners in order to provide a small space or relief to overcome the initial force. Top downwardly-extending male locking projection 30 includes rounded corners 40 as shown in FIG. 5A. Top locking element set 26 in bottom portion 14 additionally has a chamfered edge 42 which runs along an inside edge 44 of top male locking projection 30 as shown in FIGS. 5A-5D and 6A, 6B. Support post 38 also includes rounded edges 46. Rounded corners 40, chamfered edge 42 and rounded edges 46 provide a small space or relief when top downwardly-extending male locking projection 30 is initially press fit into respective bottom channels 24. This space or relief is especially necessary in case any excess flashing remains on interlocking element sets 16 and 26. For example, if a small piece of flashing remains on bottom upwardly-extending male locking projection 20, chamfered edge 42 of top male locking projection 30 will provide space or relief for the flashing and will allow top downwardly-extending male locking projection 30 to be fit into bottom channel 24. Even if no excess flashing exists, chamfered edge 42 will allow top upwardly-extending male locking projection 30 to enter into bottom channel 24 and overcome the initial force of fitting and locking tiles 10 together.

In order to interlock tiles 10 together, a pair of tiles 10 are positioned adjacent each other as shown in FIG. 7A, but may also be staggered as mentioned above and shown in FIG. 9. Top male locking projection 30 of top interlocking element set 16 is inserted into bottom channel 24 of adjacent tile 10. Rounded corners 40, chamfered edge 42 and rounded edges 46 provide a small space or relief when top downwardly-extending male locking projection 30 is initially press fit into respective bottom channels 24. Bottom upwardly-extending male locking projection 20 is then inserted into top channel 34 of top interlocking element set 26. The square cross-section configuration of male locking projections 20 and 30 maintain the connection between adjacent tiles 10 and prevent lateral movement of tiles 10 when placed on top of a subfloor as shown in FIG. 7B. Since tile 10 is flexible, respective interlocking element sets 16 and 26 can slightly deform when engaged with one another to secure tiles together and provide a tight joint. FIG. 7C shows multiple tiles 10 being joined together.

Bottom portion 14 includes a continuous grid of shallow flat round studs 50 that flow uninterrupted into adjacent tiles 10 when installed as shown in FIG. 8B. Studs 50 may provide moisture flow when uncured concrete (or moist subflooring) is still drying, and more cushioning effect for tile 10 when a load is imposed thereon such as when tiles 10 are walked upon, vehicles are transported across, cleaning and repair equipment are disposed thereon or the like. The use of studs 50 provide less contact with the subfloor. If the subfloor has old adhesive or contaminants, it will be easier to pull up, if needed. Thus, studs 50 are easier to disengage from a floor or subfloor, facilitating installation and removal of particular tiles 10.

In addition to being made at least partially from recycled material the interlocking floor tile of the present invention also includes other beneficial characteristics. For example, the interlocking floor tile is fire resistant and has a Class 1 Flame Rating.

Tiles according to the present invention can be easily maintained by using a damp mop or microfiber pad along with a minimal amount of water and cleaning solution. This maintenance technique avoids water migrating to the subfloor through the hidden locking mechanism.

Although the invention has been described with regard to certain preferred example embodiments, it is to be understood that the present disclosure has been made by way of example only, and the improvements, changes and modifications in the details of construction and the combination and arrangement of parts may be resorted to without departing from the spirit and scope of the invention. Such improvements, changes and modifications within the skill of the art are intended to be covered by the scope of the present disclosure.

What is claimed:

1. A flexible interlocking floor tile having a rectangular shape for being placed over a floor or subfloor, said floor tile comprising:

a top layer;

outwardly-facing top sidewalls on two first adjacent side portions of said tile;

a bottom interlocking element set including a bottom base extending outwardly from each of said outwardly-facing top sidewalls and a bottom upwardly extending male locking projection, said bottom upwardly extending male locking projection having an inwardly-facing bottom sidewall spaced from each of said outwardly-facing top sidewalls defining a bottom channel therebetween;

a bottom base element connecting respective bottom interlocking element sets on said respective two first adjacent side portions, said bottom base element defining an outer corner and being devoid of any male locking portion projecting therefrom;

a base layer;

outwardly-facing bottom sidewalls on two second adjacent side portions of said tile opposite said respective two first adjacent side portions, said two second adjacent side portions meeting at an upper corner of said floor tile;

a top interlocking element set including a top base extending outwardly from each of said outwardly-facing bottom sidewalls and a top male downwardly extending locking projection, said top male downwardly extending locking projection having an inwardly-facing top sidewall spaced from each of said outwardly-facing bottom sidewalls defining a top channel therebetween;

a top base element connecting respective top interlocking element sets on said two second adjacent side portions of said tile and forming said upper corner of said floor tile, said top base element including a downwardly depending support post for providing support in conjunction with the bottom base element in response to said support post being seated on said top base element when multiple ones of said tiles are joined together; and a top portion and a bottom portion, said top portion including a resilient first material having a rubber component and facing away from the floor or subfloor when said flexible interlocking floor tile is placed on a floor or subfloor, and said bottom portion including a resilient second material different from said first material and having a rubber component and facing the floor or subfloor when said flexible interlocking floor tile is placed on the floor or subfloor; said top portion and said bottom portion being combined together by vulcanization to form said flexible interlocking floor tile as a dual construction, said dual construction comprising said top portion and said bottom portion;

wherein said top portion comprises said top layer, said outwardly-facing top sidewalls, said bottom interlocking element set, said bottom base element, said top interlocking element set, and said top base element; and said bottom portion comprises said base layer and said outwardly-facing bottom sidewalls.

2. A flexible interlocking floor tile according to claim 1 wherein said top interlocking element set comprises said resilient first material and said resilient second material.

3. A flexible interlocking floor tile according to claim 1 wherein said bottom interlocking element set comprises said resilient first material and said resilient second material.

4. A flexible interlocking floor tile according to claim 1 wherein said top layer further comprises an upper edge on each side portion of said tile, said respective upper edges being curved or canted to provide an aesthetic appeal even when sunlight strikes said flexible interlocking floor tile at a very small angle.

5. A flexible interlocking floor tile according to claim 1 wherein said tile comprises approximately 73% recycled rubber and approximately 27% new rubber.

6. A flexible interlocking floor tile according to claim 1 wherein said bottom portion is 7.5 mm in height and said top portion is 2.0 mm in height.

7. A flexible interlocking floor tile according to claim 1 wherein said top male downwardly extending locking projection comprises a chamfer along an inside edge thereof to facilitate press fitting with said top male downwardly extending locking projection into said bottom channel of said bottom interlocking set.

8. A flexible interlocking floor tile according to claim 1 wherein said first material is a relatively hard material and said second material is a relatively soft material.

9. A flexible interlocking floor tile according to claim 8 wherein said base layer comprises said resilient first material and said resilient second material.

10. A flexible interlocking floor tile according to claim 1 wherein said first material is a relatively hard rubber and said second material is a relatively soft recycled rubber.

11. A flexible interlocking floor tile according to claim 10 wherein said first material is composed of SBR rubber, and said second material is composed of a rubber selected from the group consisting of industrial rubber scrap, recycled rubber and vulcanized recycled rubber dust.

12. A flexible interlocking floor tile according to claim 1 wherein said top layer is rectangular in shape and defined by four uninterrupted side walls and said bottom layer is rectangular in shape and defined by four uninterrupted side walls.

13. A flexible interlocking floor tile according to claim 1 wherein said base layer of said bottom portion comprises a continuous grid of shallow flat studs for engaging a floor or subfloor when said flexible interlocking floor tile is placed over a floor or subfloor for providing for moisture flow along the floor or subfloor and for providing a cushioning effect for said flexible floor or subfloor.

14. A flexible interlocking floor tile according to claim 1 wherein each of said bottom interlocking element set and said top interlocking element set run the full length of said flexible interlocking floor tile for making for the easy removal of any excess flashing with a utility knife using one continuous motion, for facilitating the locking together of two flexible interlocking floor tiles using a hand seam roller, for preventing realignment problems of said flexible interlocking floor tiles, and for enabling said flexible interlocking floor tiles to be laid out in staggered form rather than being arranged corner-to-corner.

15. A flexible interlocking floor tile according to claim 14 wherein said top layer is rectangular in shape and defined by four uninterrupted side walls and said bottom layer is rectangular in shape and defined by four uninterrupted side walls.

16. A flexible interlocking floor tile according to claim 1 wherein the components of said bottom interlocking element set and said top interlocking element set are perpendicular to each other for maintaining a tight joint as said respective male locking projections are press fit into said respective top and bottom channels.

17. A flexible interlocking floor tile having a rectangular shape for being placed over a floor or subfloor, said floor tile comprising:

a top layer;

outwardly-facing top sidewalls on two first adjacent side portions of said tile;

a bottom interlocking element set including a bottom base extending outwardly from each of said outwardly-facing top sidewalls and a bottom upwardly extending male locking projection, said bottom upwardly extending male locking projection having an inwardly-facing bottom wall spaced from each of said outwardly-facing top sidewalls defining a top channel therebetween;

a bottom base element connecting respective bottom interlocking element sets on said respective two first adjacent side portions, said bottom base element defining an outer corner and being devoid of any male locking portion projecting therefrom;

a base layer;

outwardly-facing bottom sidewalls on two second adjacent side portions of said tile opposite said respective two first adjacent side portions;

a top interlocking element set including a top base extending outwardly from each of said outwardly-facing bottom sidewalls and a top male downwardly extending locking projection, said top male downwardly extending locking projection having a top inner wall spaced from each of said outwardly-facing bottom sidewalls defining a top channel therebetween; and a top base element connecting respective top interlocking element sets on said two second adjacent side portions of said tile, said top base element including a downwardly depending support post for providing support in conjunction with said bottom base element in response to said support post being seated on said top base element when multiple ones of said tiles are joined together.

18. A flexible interlocking floor tile having a rectangular shape for being placed over a floor or subfloor, said floor tile comprising:

a top layer;

outwardly-facing top sidewalls on two first adjacent side portions of said tile;

a bottom interlocking element set including a bottom base extending outwardly from each of said outwardly-facing top sidewalls and a bottom upwardly extending male locking projection, said bottom upwardly extending male locking projection having an inwardly-facing bottom sidewall spaced from each of said outwardly-facing top sidewalls defining a bottom channel therebetween;

a bottom base element connecting respective bottom interlocking element sets on said respective two first adjacent side portions, said bottom base element defining an outer corner and being devoid of any male locking portion projecting therefrom;

a base layer;

outwardly-facing bottom sidewalls on two second adjacent side portions of said tile opposite said respective two first adjacent side portions, said two second adjacent side portions meeting at an upper corner of said floor tile;

a top interlocking element set including a top base extending outwardly from each of said outwardly-facing bottom sidewalls and a top male downwardly extending locking projection, said top male downwardly extending locking projection having an inwardly-facing top sidewall spaced from each of said outwardly-facing bottom sidewalls defining a top channel therebetween;

a top base element connecting respective top interlocking element sets on said two second adjacent side portions of said tile and forming said upper corner of said floor tile, said top base element including a downwardly depending support post for providing support in conjunction with the bottom base element in response to said support post being seated on said top base element when multiple ones of said tiles are joined together; and a top portion and a bottom portion, said top portion including a resilient first material having a rubber component and facing away from the floor or subfloor when said flexible interlocking floor tile is placed on a floor or subfloor, and said bottom portion including a resilient second material different from said first material and having a rubber component and facing the floor or subfloor when said flexible interlocking floor tile is placed on the floor or subfloor, said resilient second material being relatively soft compared to said resilient first material; and said top portion and said bottom portion being combined together by vulcanization to form said flexible interlocking floor tile as a dual construction, said dual construction comprising said top portion and said bottom portion;

wherein said top portion comprises said top layer, said outwardly-facing top sidewalls, said bottom interlocking element set, said bottom base element, said top interlocking element set, and said top base element; and said bottom portion comprises said base layer and said outwardly-facing bottom sidewalls.

19. A flexible interlocking floor tile according to claim 18 wherein said top interlocking element set comprises said resilient first material and said resilient second material.

20. A flexible interlocking floor tile according to claim 18 wherein said bottom interlocking element set comprises said resilient first material and said resilient second material.

21. A flexible interlocking floor tile according to claim 18 wherein said top layer further comprises an upper edge on each side portion of said tile, said respective upper edges being curved or canted to provide an aesthetic appeal even when sunlight strikes said flexible interlocking floor tile at a very small angle.

22. A flexible interlocking floor tile according to claim 18 wherein said tile comprises approximately 73% recycled rubber and approximately 27% new rubber.

23. A flexible interlocking floor tile according to claim 18 wherein said bottom portion is 7.5 mm in height and said top portion is 2.0 mm in height.

* * * * *

UNITED STATES PATENT AND TRADEMARK OFFICE

CERTIFICATE OF CORRECTION

PATENT NO. : 8,726,602 B2
APPLICATION NO. : 13/311979
DATED : May 20, 2014
INVENTOR(S) : DeLong It is certified that error appears in the above-identified patent and that said Letters Patent is hereby corrected as shown below:

In the Claims

Claim 1, line 12, delete “sidewall” and insert --wall--.

Claim 12, line 3, delete “bottom” and insert --base--.

Claim 17, line 13, delete “top” and insert --bottom--.

Claim 18, line 12, delete “sidewall” and insert --wall--.

Signed and Sealed this
Twenty-third Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,726,602 B2
APPLICATION NO. : 13/311979
DATED : May 20, 2014
INVENTOR(S) : DeLong It is certified that error appears in the above-identified patent and that said Letters Patent is hereby corrected as shown below:

In the Claims

Column 10, Claim 1, line 35, delete “sidewall” and insert --wall--.

Column 11, Claim 12, line 54, delete “bottom” and insert --base--.

Column 12, Claim 17, line 29, delete “top” and insert --bottom--.

Column 13, Claim 18, line 64, delete “sidewall” and insert --wall--.

This certificate supersedes the Certificate of Correction issued September 23, 2014.

Signed and Sealed this
Fourteenth Day of October, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,726,602 B2
APPLICATION NO. : 13/311979
DATED : May 20, 2014
INVENTOR(S) : DeLong It is certified that error appears in the above-identified patent and that said Letters Patent is hereby corrected as shown below:

In the Specification

Column 7, line 29, delete "1 ic" and insert --11c--; line 40, after "...projection 30 has an inner wall" insert --or inwardly-facing top sidewall--; line 50, change "228" to --28--.

In the Claims

Column 10, Claim 1, line 35, delete "sidewall" and insert --wall--.

Column 11, Claim 12, line 54, delete "bottom" and insert --base--.

Column 12, Claim 17, line 29, delete "top" and insert --bottom--.

Column 12, Claim 18, line 64, delete "sidewall" and insert --wall--.

This certificate supersedes the Certificates of Correction issued September 23, 2014 and October 14, 2014.

Signed and Sealed this
Fifth Day of May, 2015

Michelle K. Lee

Michelle K. Lee
*Director of the United States Patent and Trademark Office*